US005206974A

United States Patent [19]

Lautenschläger

[11] Patent Number: 5,206,974

[45] Date of Patent: May 4, 1993

[54] MOUNTING PLATE FOR FURNITURE HINGES AND METHOD FOR MANUFACTURING IT

[75] Inventor: Karl Lautenschläger, Reinheim, Fed. Rep. of Germany

[73] Assignee: Karl Lautenschläger GmbH & Co. KG Möbelbeschlagfabrik, Reinheim, Fed. Rep. of Germany

[21] Appl. No.: 749,871

[22] Filed: Aug. 26, 1991

[30] Foreign Application Priority Data

Sep. 10, 1990 [DE] Fed. Rep. of Germany ..... 4028653

[51] Int. Cl.[5] ..... E05D 7/06; E05D 7/12; B21D 53/40; B21K 13/02

[52] U.S. Cl. ..... 16/240; 16/272; 16/DIG. 43; 16/DIG. 42; 29/11

[58] Field of Search ..... 16/DIG. 43, DIG. 42, 16/236, 238, 240, 245

[56] References Cited

U.S. PATENT DOCUMENTS 4,641,393 2/1987 Lautenschlager ..... 16/DIG. 43
4,862,555 9/1989 Grass ..... 16/DIG. 43

FOREIGN PATENT DOCUMENTS 2307107 11/1976 France ..... 16/272

*Primary Examiner*—John Sipos
*Assistant Examiner*—Carmine Cuda

[57] ABSTRACT

The present invention relates to a mounting plate (30) for an adjustable mounting of a hinge supporting arm on a cabinet. The mounting plate is made by punching and pressing operations from sheet metal, of a U-shaped cross section at least in an upper section facing the supporting arm to be mounted thereon. The mounting plate has in its cabinet-interior end area a threaded bore for a screw (38) locking the hinge supporting arm, plus an open-ended longitudinal slot (39) at its end pointing out of the cabinet interior. Along the margins of the web (52) of the mounting plate (30), which laterally define the slot, ridges are raised from the plane of the web (52), and the distance measured from one flat side of the undeformed web to the opposite boundary surface of the upturned ridges is greater than the material thickness of the web (52) in the undeformed area.

7 Claims, 3 Drawing Sheets

MOUNTING PLATE FOR FURNITURE HINGES AND METHOD FOR MANUFACTURING IT

BACKGROUND OF THE INVENTION

The invention relates to a mounting plate for the adjustable mounting of the supporting arm of a hinge on the wall of a cabinet. It is manufactured, at least in an upper portion facing the supporting arm, with an inverted U-shaped cross section by stamping from sheet metal. It has a tap at its cabinet-interior end for a screw for fastening the supporting arm, and an open-ended longitudinal slot at its outer end, into which there can be inserted a neck of reduced diameter on a threaded spindle, which is provided on the bottom end, adjacent the mounting plate, of a threaded portion screwed into a tap in the supporting arm; the end of the neck remote from the threaded portion bears a holding head of enlarged diameter, and the length of the neck section is greater than the thickness of the sheet-metal used in making the mounting plate. The invention relates also to a method for manufacturing same. Such mounting plates manufactured from metal strip material in a series of successive punching and pressing operations are growing in popularity in comparison with mounting .plates manufactured by injection molding from plastic and by pressure casting from metal alloys, because they have considerably greater strength than plastic mounting plates and appreciably lower weight than pressure-cast mounting plates, while offering at least equal strength and accordingly lower manufacturing cost. Furthermore, if the mounting plates are manufactured from spring metal it is possible by means of appropriate design to make use of the spring properties in catch mechanisms. Such use is published, for example, in German Patent Disclosure Document OS 38 03 830, which discloses a two-member mounting plate whose upper member is made from sheet metal and can be snapped onto the bottom member by means of two integral resilient tongues, although it is very easily detached by squeezing the tongues together and then removing it from the bottom member, together, if desired, with a support arm held on the upper part. The adjustable mounting of the supporting arm of a cabinet hinge on the mounting plate, or on an upper mounting plate member, is performed on the one hand by the screws driven into the tap in the cabinet-interior end portion and tightly locking the supporting arm on the mounting plate, also in a positively interlocking manner by means of serrations or the like, and on the other hand by a spindle whose threaded shaft is threaded into a tap in the forward end part of the supporting arm, while it is made longitudinally adjustable on the mounting plate by providing on the mounting-plate end of the threaded shaft an unthreaded neck section of reduced diameter, which then merges with a holding head of larger diameter. The neck section is inserted into a slot of sufficient width to accommodate it, that is open at the front end and displaceable within the length of the slot, but secured against lifting away from the mounting plate. It is clear that the neck section must be matched to the width of the slot not only in its diameter bu also in its length to the thickness of the material in the web of the arm in order to avoid unacceptable free play between the neck section—and hence the supporting arm, and the mounting plate in the front supporting arm area. Threaded spindles with a neck section and a holding head for the adjustable attachment of the hinge's supporting arm are used by hinge manufacturers also for mounting the supporting arms on mounting plates of plastic and diecast metal. The hinge manufacturers have sized the various mounting plates, and the means for fastening the supporting arms, i.e., the threaded spindles, as well, so that the supporting arms of hinges can be mounted in the same manner on mounting plates of plastic, die-cast metal or sheet metal. But the result is that the neck section of the threaded spindle has to be given a length corresponding to the wall thickness of the portion of plastic mounting plates laterally defining the slot. Since plastic has comparatively less strength than sheet metal, relatively great wall thicknesses must be provided in the slot area, i.e., the neck section of the threaded spindle has a given length, which heretofore has made it necessary for sheet-metal mounting plates to be made of a sheet-metal having a thickness corresponding approximately to the length of the neck section of the threaded spindles. From the viewpoint of strength, mounting plates of sheet metal of such thickness were then, as a rule, oversize. Making them of thinner sheet metal, however, was impossible because then special threaded spindles with shorter neck sections would have had to be used, which would have made impossible the optional mounting of the hinge supporting arms on mounting plates of different materials.

Consequently, it is the object of the invention to offer a mounting plate or part of a mounting plate manufactured by stamping, which is made of sheet-metal material of reduced thickness, and nevertheless permits a strong and tight mounting of supporting arms of hinges, wherein the threaded spindle serving for mounting them in the area of the longitudinal slot in the web of the mounting plate remains unchanged, i.e., permits the supporting arm to be mounted on mounting plates of different materials.

THE INVENTION

Setting out from a mounting plate of the kind mentioned above, this object is achieved in accordance with the invention in that ridges are formed out of the plane of the web along the edges in the web of the mounting plate which define the sides of the slot, so that the distance measured from one flat side of the unformed web to the opposite boundary of the outwardly bent ridge is greater than the thickness of the web in the unbent area. Thus, it is possible to make a sufficient depth of material available in the area of the slot in the mounting plate, to correspond to the length of the neck of the corresponding threaded spindle, even though the thickness of the mounting plate itself is decidedly less than the length of the neck of the spindle. Beyond their mere function as spacing ridges to compensate the difference between the thickness of the mounting plate and the length of the neck of the threaded spindle, the bent ridges also serve as reinforcing ribs which resist the flexure or deformation of the lateral margins of the slot. The mounting plate according to the invention can therefore be made from decidedly thinner sheet metals, which leads to a substantial reduction of the manufacturing costs, not only on account of the cost advantage of the material but also on account of the reduced wear on the punching and pressing dies. An optimal close fit of the neck of the spindle in the slot in the mounting plate is achieved when the distance measured from one flat side of the undeformed web to the other boundary surface of the ridge is greater, by an amount permitting the substantially close fit of the neck of the spindle, than the material thickness of the undeformed web of the mounting plate.

The holding heads provided on the end of the neck of the threaded spindle remote from the threaded portion can be of various shape. While flat, discoidal holding heads were originally provided, the applicant has developed and employed threaded spindles with spherical or partially spherical holding heads, resulting in decided improvements over the discoidal holding heads as regards the adjustability of the supporting arm on the mounting plate. For mounting hinge supporting arms with such threaded spindles having spherical and partially spherical holding heads, a further development of the mounting plate is recommendable, wherein the two ridges defining the slot are raised above the upper side of the web of the mounting plate, and the transition from the lateral surfaces defining the slot to the cabinet wall side of the web is in the form of chamfers flaring out to the web surface, these chamfers running at an average angle of about 45° to the associated web surface and to the associated lateral surface of the slot. The spherical portion of the holding head directly adjoining the neck thus contacts the surfaces formed by these chamfers rather than, say, sharp edges produced by the punch. The chamfers should then be arcuately curved in cross section.

In the manufacture of the mounting plate according to the invention, in addition to the usual succession of punching and pressing steps, before the operation of punching the slot out of the front end portion of the web that points out of the cabinet interior, over the width between the ridges to be created and over their length, a strip of the web running centrally lengthwise in the direction of the supporting arm is raised or drawn, whose width parallel to the slot is greater than the width of the slot later to be formed in the finished mounting plate, and then the slot is punched out of the strip.

The cuts forming the lateral surfaces of the slot are made through the raised or drawn strip such that the latter is removed except for the raised areas remaining at the margins of the slot.

Before the strip is raised from the web, the front end portion of the web, which is to be provided with the slot, is deformed to a plane running parallel to the rest of the web by the dimension of the prominence of the later permanently upturned ridges. That is, the free upper edges of the ridges thus will be flush with the undeformed part of the web.

BRIEF DESCRIPTION OF THE DRAWINGS

The invention is further explained in the following description of an embodiment, in conjunction with the drawing, wherein.

DESCRIPTION OF PREFERRED EMBODIMENTS

Figure 1:
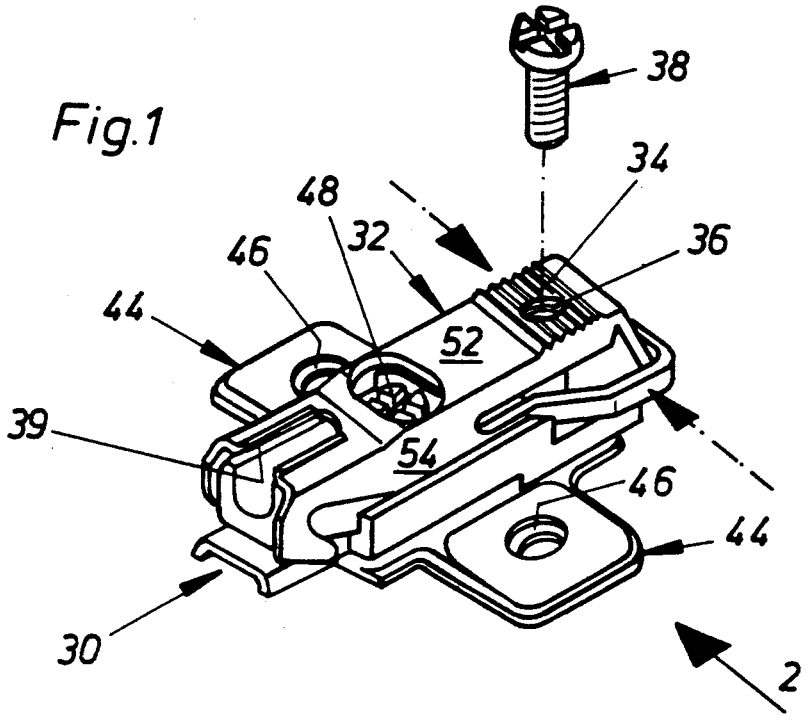
FIG. 1 is a perspective view of an embodiment of a two-member mounting plate made in the manner according to the invention.
Figure 2:
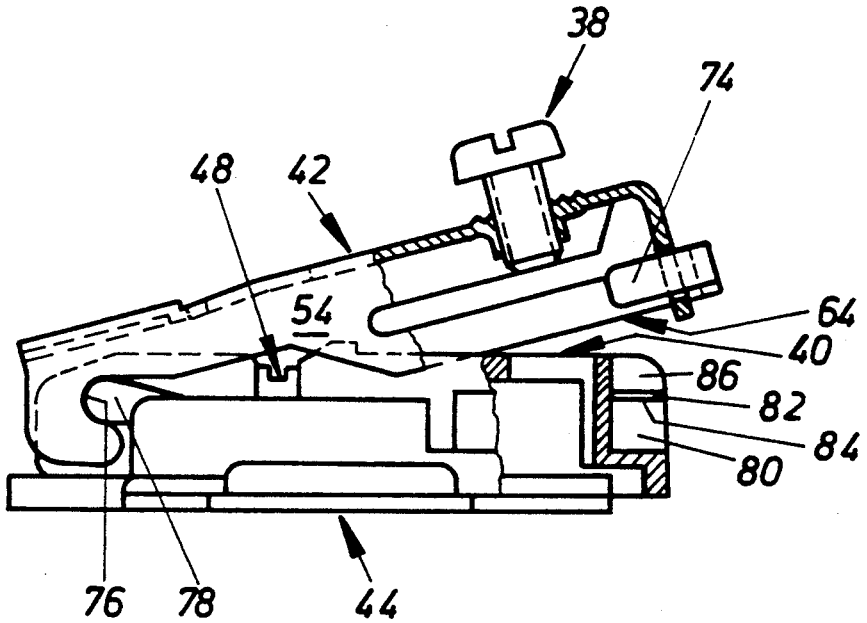
FIG. 2 is a side view of the mounting plate seen in the direction of arrow 2 in FIG. 1, wherein the upper member of the mounting plate, which is the one that is of interest in the present connection, is represented with its end portion raised upward from the lower member, and the end portions of both members are cut away to show a catch mechanism provided therein.

In FIGS. 1 and 2 there is shown an embodiment of a mounting plate, identified as a whole by 30, which is configured in the manner of the invention; on it is adjustably fastened the wall-related part of a jointed hinge in the form of an elongated supporting arm corresponding to the state of the art, which therefore is not shown. As regards the configuration of the supporting arm to be fastened on the mounting plate 30, suffice it to refer to the configuration of the hinge shown in FIGS. 1 and 2 of German Patent Disclosure Document 35 25 279 and explained in the corresponding description.

The mounting plate 30 has an elongated rectangular mounting platform 32 in whose rearward end, i.e., the end pointing into the cabinet interior, there is provided a tap 36 within an area provided with transverse serrations 34, into which the shaft of a screw 38 serving to fasten the hinge's supporting arm can be threaded. In the front end portion pointing out of the cabinet, the mounting platform 32 has a slot 39 which is open at the front end to receive a threaded spindle (not shown) for adjusting the overlap of the door.

The mounting plate 30 is, in the depicted case, made in two parts and is composed of a bottom mounting plate member 40 to be fastened directly on the cabinet wall and made, not of sheet metal, but of die-cast metal, and an upper mounting plate member 42 (FIGS. 2, 3 and 4) of sheet metal, which is snapped onto the bottom mounting plate part, and is the member that is involved in the present invention. In the embodiment depicted, the mounting plate 30 is a so-called "wing plate," in which a wing 44 projects from opposite sides of a rectangular central mounting platform 32 serving for the adjustable mounting of a corresponding hinge supporting arm; these wings usually serve for fastening the mounting plate on the cabinet wall. The upper mounting plate member constituting the upper platform 32 is placed on the bottom mounting plate member and attached to it in the manner to be described below. The wings 44 are the outer extremities of a one-piece wing plate made separately—again by punching and pressing from sheet metal—and fitted into a recess in the bottom of the lower mounting plate member 40 and screwed thereto. To fasten the mounting plate 30 on a cabinet, screws (not shown) are driven through countersunk holes 46 in the wings 44 (FIG. 1). The wing plate formed by the wings 44 and the bottom mounting plate member 42 are in turn fastened together by a screw 48 (FIGS. 1 and 2) whose shaft is passed through an oblong hole 50 running transversely of the length of the mounting plate and is driven into a tap (not shown) in the wing plate. When the screw 48 is loosened, therefore, a certain shifting of the bottom mounting plate member 44 relative to the wing plate is possible, within the length of the oblong hole 50, i.e., it is possible to adjust the level of a hinge mounted on the mounting plate 30.

Figure 3:
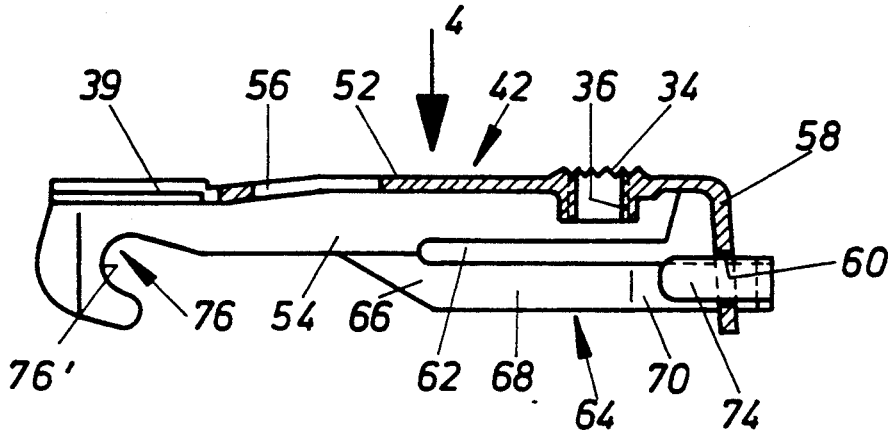
FIG. 3 shows a section taken through the upper member of the mounting plate shown in FIGS. 1 and 2, in the plane defined by the arrows 3—3 in FIG. 4.
Figure 4:
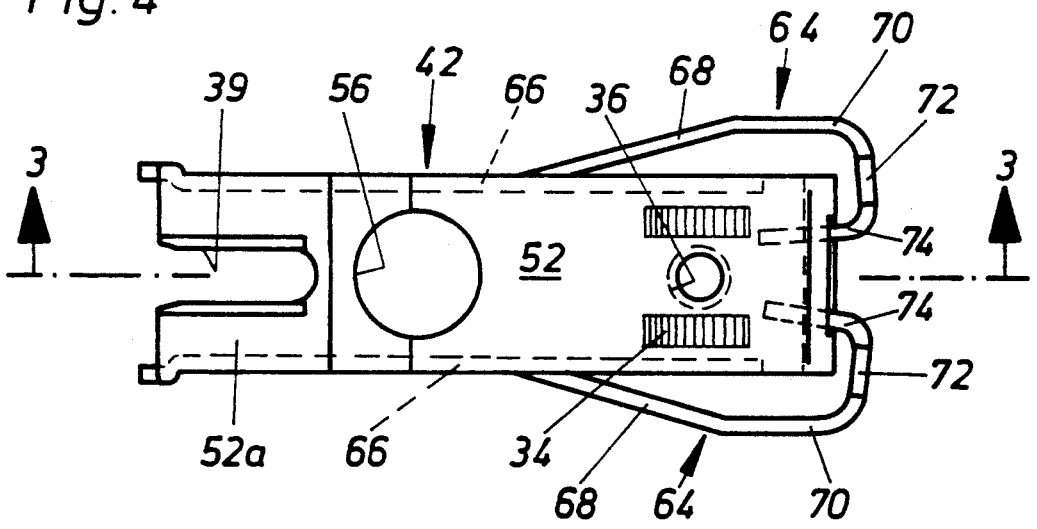
FIG. 4 is a top view of the upper member of the mounting plate, seen in the direction of arrow 4 in FIG. 3.
Figure 5:
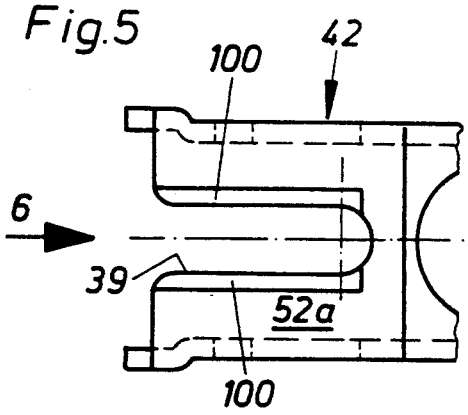
FIG. 5 is a view on a larger scale than that of FIG. 4 of the forward end portion of the upper mounting plate member.
Figure 6:
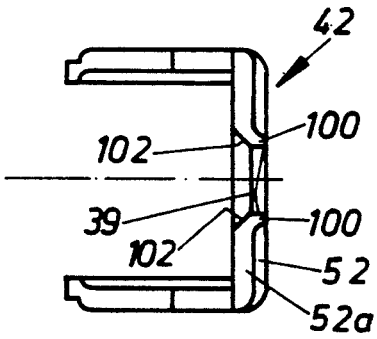
FIG. 6 is a view seen in the direction of arrow 6 in FIG. 5.

The upper mounting plate member 42 represented separately in FIGS. 3 and 4 has an inverted-U-shaped cross section, i.e., it is composed of an upper elongated web 52 and flanges 54 extending from its opposite longitudinal margins and straddling the bottom mounting plate member 40, an open-ended longitudinal slot 39 and an opening 56 being provided in the web 52, which permit the loosening or tightening of the screw 48. In the rear end, i.e., the end pointing into the cabinet interior, the web 52 is bent downward to form an end wall 58 in which a transversely disposed, window-like opening 60 is provided (or two window-like openings 60 side by side).

By means of a cut or slot 62 made in the flanges 54 and running from the cabinet-interior end parallel to the web 52, elongated strips are created which form the resilient tongues 64 to be further described below, which in turn are part of a catch mechanism permitting the rear ends of the top and bottom mounting plate members 42 and 40 to be releasably locked together.

The strips 64 forming the tongues are thus integral at their front ends with the flanges 54. Upon the lateral application of pressure, the tongues flex resiliently, preferably at 66. The flexural point 66 is adjoined in each case by an outwardly angled section 68 pointing toward the cabinet interior, which is in turn adjoined by a section 70 running approximately parallel to the longitudinal central axis and forming a handle, followed by a section 72 bent inwardly toward the longitudinal central axis, from which a final section is bent to form the actual catch 74 of each resilient tongue, in such a manner that these sections 74 enter through the window-like opening or openings 60 in the rearward end wall 58, into the interior of the upper mounting plate member 42.

At the forward end of each flange 54 of the upper mounting plate member 42 a hook 76 with its gap facing rearward at an angle is formed with a partially arcuate throat.

The hooks 76 are associated with projections 78 provided laterally on the bottom mounting plate member and arcuately shaped to complement the throat of the hooks, so that it is possible to raise the rearward end in the manner shown in FIG. 2 and draw the hooks 76 of the upper mounting plate member 52 over the projections 78 and then, after placing the arcuate edges against one another, to lower the rearward end of the upper mounting plate member down onto the bottom mounting plate member 40. The catches 74 of the tongues 64, bent back into the interior of the mounting plate member 52, will pass into the recess 80 provided at the rearward end of the bottom mounting plate 40 and opening at the top and rear edge, which is narrowed at the top by inwardly directed projections 82. The bottoms of the projections 82 are therefore undercut surfaces 84, while the oppositely lying upper surfaces are configured as ramps 86 slanting from the top downward. When the rearward end of the mounting plate member 42 is lowered onto mounting plate member 40, the inner ends of catches 74 come in contact with the ramps 86 and then, with the resilient flexing of the tongues 64 as a whole, they slide down on the ramps 86 until their upper margins, upon reaching the proper catching position, pass over the narrow point formed between the projections 82 and snap behind the undercut surfaces 84. Then the upper edge of the catches 74 lock against the associated undercut surface 84, while their bottom edge rests on the lower horizontal edge of the window-like opening 60. Then it is no longer possible to raise the upper mounting plate member 42, unless first the catch 74 is forced inwardly by exerting pressure on the handle-forming tongue sections 70 so that they come free of the undercut surfaces 84. It is important that both of the catches 74 come free of their associated undercut surface 84, which obviously requires the exertion of oppositely directed releasing forces on both of the tongues. In practice, this can best be done by squeezing the tongues together with the thumb and index finger of one hand. As soon as the upper mounting plate member is unlocked from the bottom mounting plate member, i.e., when the catches 74 come free of the undercut surfaces 84, the rearward end of the upper mounting plate member 42 can be lifted upward with the same hand. If the supporting arm of a hinge is fastened to the upper mounting plate member 42 it will, of course, be raised together with the latter, this being possible because it is articulated by its linkage mechanism to the door-related part of the hinge. To this extent the mounting plate 30 described corresponds to the mounting plate disclosed in German Patent Disclosure Document 38 03 830 in which the thickness of the sheet metal used in making the upper mounting plate member is selected in accordance with the length of the neck of a threaded spindle threaded in the supporting arm of a cabinet hinge and serving to hold it and adjust it on the mounting plate.

On the other hand, let it be assumed that the thickness of the material of the upper mounting plate member 42 (or of the entire mounting plate in the case of a one-piece mounting plate) is less. If in the known mounting plate a sheet metal thickness of 1.5 mm was used, the mounting plate member 42 is now to be made from metal 1 mm thick. Then the previously described problem arises, that the neck 90 of the threaded spindle 92 of a corresponding hinge supporting arm 94 (FIGS. 7 and 8), which is to be inserted into the slot 39, is of a length corresponding to the original material thickness of 1.5 mm of the known mounting plate, i.e., when the slot 39 was made in the mounting plate member 42 according to the invention by simply punching material out of the web 52, the distance between the bottom end of the threaded shaft 96 adjoining the neck and the disk-like holding head 98 at the opposite end of the neck 90 (FIG. 7) or the spherical holding head 98' of the threaded spindle 92 is greater than the thickness of the slot edges or lateral areas defining the slot 39 would be, and the supporting arm 94 would therefore be held on the mounting plate with considerable free play (about 0.5 mm) in the direction of the longitudinal central axis of the spindle 92. Such free play would make the supporting arm 94 unstable even if it were pressed tightly onto the mounting plate member 42 by the screw 38, and it is therefore unacceptable.

To compensate this free play, narrow ridges 100 are formed out of the plane of the web 52 along the lateral margins of the slot 39 of the mounting plate 42, and their height above the web surface corresponds precisely to the difference between the length of the neck 90 and the material thickness of the (undeformed) web 52. On the bottom opposite the raised narrow ridges 100, the transitions between the ridges 100 and the flat bottom of the web 52 have chamfers 102 facing one another at an average angle of about 45° to the web and to the associated lateral surfaces of the slot.

Figure 7:
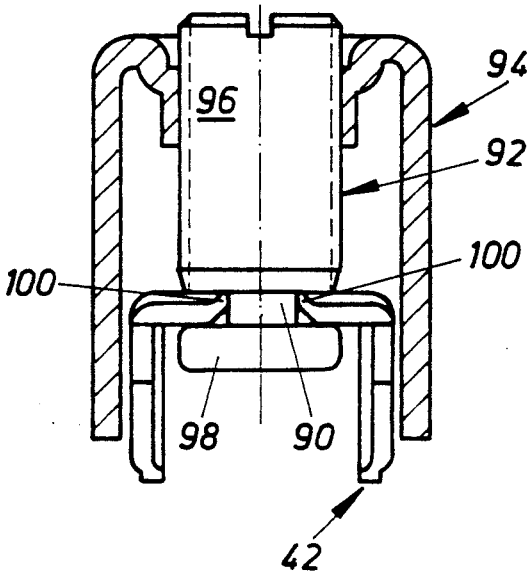
FIG. 7 is a view corresponding to FIG. 6 of the upper mounting plate member rotated 90°, also showing in section the supporting arm of a corresponding hinge, provided with the threaded spindle, and the holding head of the spindle is in the form of a flat disk.
Figure 8:
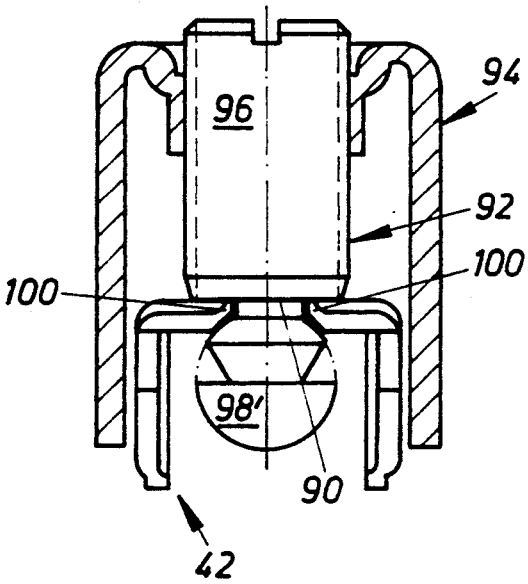
FIG. 8 is a view corresponding to FIG. 7, in which the holding head of the threaded spindle is spherical.

The chamfers 102 can be either planar or arcuate in cross section. If a threaded spindle 92 with a spherical or at least partially spherical holding head 98' is used, as in FIG. 8, this holding head engages these chamfers 102, while if the spindle 92 with disk-shaped holding head 98 shown in FIG. 7 is used, its flat side facing the threaded shaft 96 engages the flat bottom of the web 52.

Figure 9:
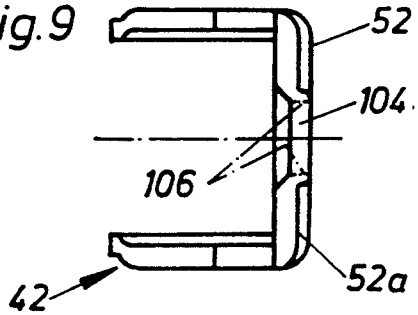
FIG. 9 is a view corresponding to FIG. 6 of the upper mounting plate member in a preliminary manufacturing step, in which the slot is not yet punched out of the mounting plate web.

In the manufacture of the mounting plate member 42 (or of a one-piece mounting plate), the plate member is made in a basically known manner from metal strip material in a succession of punching and pressing operations, i.e., at sequential stations. Before the slot 39 is punched out, the rectangular section 104 of the web shown in FIG. 9 is embossed centrally in the web 52 in the area of what will later be the margins of the longitudinal slot, and its height above the upper flat side of the web 52 will correspond to the desired prominence of the ridges which will later protrude above the longitudinal slot 39, i.e., after the slot has been punched into the web. The width of the web section 104 measured transversely of the mounting plate member 42 is selected so as to be so much greater than the width of slot 39 that, in the next punching step the cuts 106 forming the lateral margins of slot 39 will go all the way through the web section 104. In the case of the mounting plate member 42 described as an embodiment and shown in the drawings, the web portion 104 is embossed upwardly from the web 52, so that it protrudes from the upper flat side, and accordingly the front portion 52*a* of web 52 containing the slot will be deformed downwardly below the surface of this area 52, to a plane that is parallel to the rearward portion of the web 52, so that the upper free edges of the ridge 100 will be flush with the upper flat side of the rearward portion of the web 52.

Instead of an upward embossing of the web portion 104, a deformation in the opposite direction is basically possible, in which case the parallel deformation of the front area 52*a* of the web 52 is unnecessary. Even so, in this configuration the holding head 98 or 98' of a threaded spindle 92 can thrust only against the edges of the ridges 100 remaining after the slot 39 is punched.

I claim:

1. Method for the production of a mounting plate for the adjustable mounting of a supporting arm of a hinge on the wall of a furniture piece, which, at least in an upper portion, facing the supporting arm to be mounted, is made with an inverted U-shaped profile by a punching and pressing process from sheet metal, wherein the mounting plate has in a carcase - interior end area a tap for a mounting screw locking the supporting arm of the hinge, and on its end pointing out of the carcase interior an open-ended longitudinal slot into which there can be inserted a reduced-diameter neck section of a threaded spindle provided at the mounting-plate-side bottom end of a threaded section screwed into a threaded bore in the supporting arm, on whose end facing away from the threaded section a holding head of increased diameter is set, said neck section extending from a bottom end of the threaded section of the threaded spindle to a top end of the holding head and the length of the neck section being greater then the thickness of the sheet metal starting material used for the making of the mounting plate, the steps comprising before a working step of punching a longitudinal slot out of a forward end portion of a web pointing out of the carcase interior, the forward end portion of the web of the mounting plate to be provided with the longitudinal slot is deformed to a plane running parallel tot he rest of the web, a ribbon-like web section is embossed or drawn for a distance between laterally raised ridges and over their length, whose width parallel to the longitudinal slot is greater than the width of the later punched longitudinal slot, and then the longitudinal slot is punched out of the ribbon-like web section.

2. Method according to claim 1, wherein the punch cuts forming the lateral surfaces of the longitudinal slot are laid through the embossed or drawn ribbon-like web section such that the latter are removed except for the outwardly formed ridges remaining at the longitudinal slot margins.

3. A mounting plate for an adjustable mounting of a supporting arm of a hinge on a wall of a furniture piece, said mounting plate includes an upper portion facing a supporting arm wherein at least said upper portion is made with an inverted U-shaped profile by punching and pressing from sheet metal, and has in a carcase-interior end area a tap for a mounting screw locking the supporting arm of the hinge, and on its end pointing out of the carcase-interior an open-ended longitudinal slot, said mounting plate includes a reduced-diameter neck section of a threaded spindle provided at a mounting-plate side bottom end of a threaded section screwed into a threaded bore in the supporting arm, on whose end facing away from the threaded section a holding head of increased diameter is set, said neck section extending from a bottom end of the threaded section of the threaded spindle to a top end of the holding head and the length of the neck section being greater than the thickness of the sheet metal starting material used for the making of the mounting plate, said reduced diameter neck section being adapted for insertion into said open-ended longitudinal slot, comprising said mounting plate including a web (52) whose forward end is deformed over the length of the longitudinal slot to a plane running parallel to the rest of the web, and said web having margins wherein along the margins of the web (52) of the mounting plate (42) which define the longitudinal slot (39), ridges (100) are formed out of the plane of the web (52), so that a distance measured from one flat side of the undeformed web (52) to the opposite boundary surface of the outwardly formed ridges (100) is greater than the material thickness of the web (52) in the undeformed area.

4. Mounting plate according to claim 3, wherein the distance measured from one flat side of the undeformed web (52) to the opposite boundary surface of the deformed ridges (100) is greater, by the dimension permitting the substantially play-free accommodation of the neck section (90) of the threaded spindle (92), then the material thickness of the undeformed web (52) of the mounting plate.

5. Mounting plate according to claim 3 or 4, wherein the two outwardly formed ridges (100) defining the longitudinal slot (92) reach above the upper flat side of the web (52) of the mounting plate (42) facing away from the supporting wall, and that the transition of the lateral surfaces defining the longitudinal slot (39) to the flat side of the web (52) that faces the supporting wall has the form of a chamfer (102) flaring toward the web.

6. Mounting plate according to claim 5, wherein the chamfers (102) run at an average of about 45° to the associated web (52) and to the associated longitudinal slot's lateral surface.

7. Mounting plate according to claim 5, wherein the chamfers (102) have an arcuate shape in cross-section.

* * * * *